US006500034B1

(12) United States Patent
Lau

(10) Patent No.: US 6,500,034 B1
(45) Date of Patent: Dec. 31, 2002

(54) WATER BICYCLE

(76) Inventor: Vincent Wai Shun Lau, Flat A, 9th Floor, Block 7, Woodland Crest, 33 Tin Ping Road, Sheung Shui, NT Hong Kong (HK)

( * ) Notice: Subject to any disclaimer, the term of this patent is extended or adjusted under 35 U.S.C. 154(b) by 0 days.

(21) Appl. No.: 09/668,967

(22) Filed: Sep. 25, 2000

(51) Int. Cl.[7] ..... B63H 16/00
(52) U.S. Cl. ..... 440/21; 440/27
(58) Field of Search ..... 440/21–32

(56) References Cited

U.S. PATENT DOCUMENTS 1,785,971 A * 12/1930 O'Connor
1,831,229 A * 11/1931 Clark
1,832,241 A * 11/1931 Rash ..... 440/27
3,182,628 A * 5/1965 Avellino ..... 440/29
5,413,066 A * 5/1995 Spencer, Jr. et al. ..... 114/354
5,643,020 A * 7/1997 Harris ..... 440/31

FOREIGN PATENT DOCUMENTS

NL 8401497 * 12/1985 ..... 440/27

* cited by examiner

*Primary Examiner*—Ed Swinehart
(74) *Attorney, Agent, or Firm*—Raymond Sun

(57) ABSTRACT

A water bicycle has a body and a drive system connected to the body. The body is made from a material that allows the body to float on water. The drive system includes a propeller that is positioned below the body, a shaft having a first end coupled to the propeller, a drive mechanism coupled to the second end of the shaft, and a control coupled to the drive mechanism. The water bicycle can also include a steering system operatively connected to the body, the steering system having a rudder, a handle, and a link assembly operatively coupling the handle and the rudder.

29 Claims, 6 Drawing Sheets

WATER BICYCLE

BACKGROUND OF THE INVENTION

1. Field of the Invention

The present invention relates to a water bicycle for recreational use in a pool, at the beach, or at other water locales.

2. Description of the Prior Art

Outdoor and water-related activities are becoming increasingly popular. For example, many people now enjoy spending recreation time by a swimming pool, by the beach, or even at creeks and streams. To enhance enjoyment during such recreation time, a wide variety of water recreation items have been provided. Many of these water recreation items provide the users with water-related activities. For example, many inflatable devices have been provided to assist flotation, such as floating chairs and recliners. Other examples include floating games (such as floating basketball nets), mattresses, floats, lounge islands, boats and others, which provide different types of water-related activities.

One other type of water recreation item is a paddle boat. These paddle boats are very popular because they allow the user to traverse and move about the water without getting wet, and can be used to promote other fun activities such as races between two or more such paddle boats. Existing paddle boats are designed to seat one or two individuals, and are provided with a large flywheel at the rear of the boat that is rotated to cause to the paddle boat to move through the water. Unfortunately, these paddle boats are large and bulky because the flywheel can be quite large. The large size of these flywheels also requires the user to exert much force to paddle the boat. In addition, many of the existing paddle boats do not provide any steering capability.

Thus, there remains a need for an improved water bicycle that allows a user to conveniently traverse and move about the water, and which overcomes the drawbacks mentioned above.

SUMMARY OF THE DISCLOSURE

It is an objective of the present invention to provide a water bicycle that can be used by a user to conveniently move about the surface of the water.

It is another objective of the present invention to provide a water bicycle that is simple in construction and operation, and which does not occupy much space.

The objectives of the present invention are accomplished by providing a water bicycle having a body and a drive system connected to the body. The body is made from a material that allows the body to float on water. The drive system includes a propeller that is positioned below the body, a shaft having a first end coupled to the propeller, a drive mechanism coupled to the second end of the shaft, and a control coupled to the drive mechanism. The water bicycle of the present invention can also include a steering system operatively connected to the body, the steering system having a rudder, a handle, and a link assembly operatively coupling the handle and the rudder.

In one embodiment of the present invention, the link assembly includes a steering shaft having one end connected to the handle, a first flywheel coupled to another end of the steering shaft, a second flywheel coupled to the rudder, and a pair of crossing rods each having opposing ends connected to the first and second flywheels.

DETAILED DESCRIPTION OF THE PREFERRED EMBODIMENTS

Figure 1:
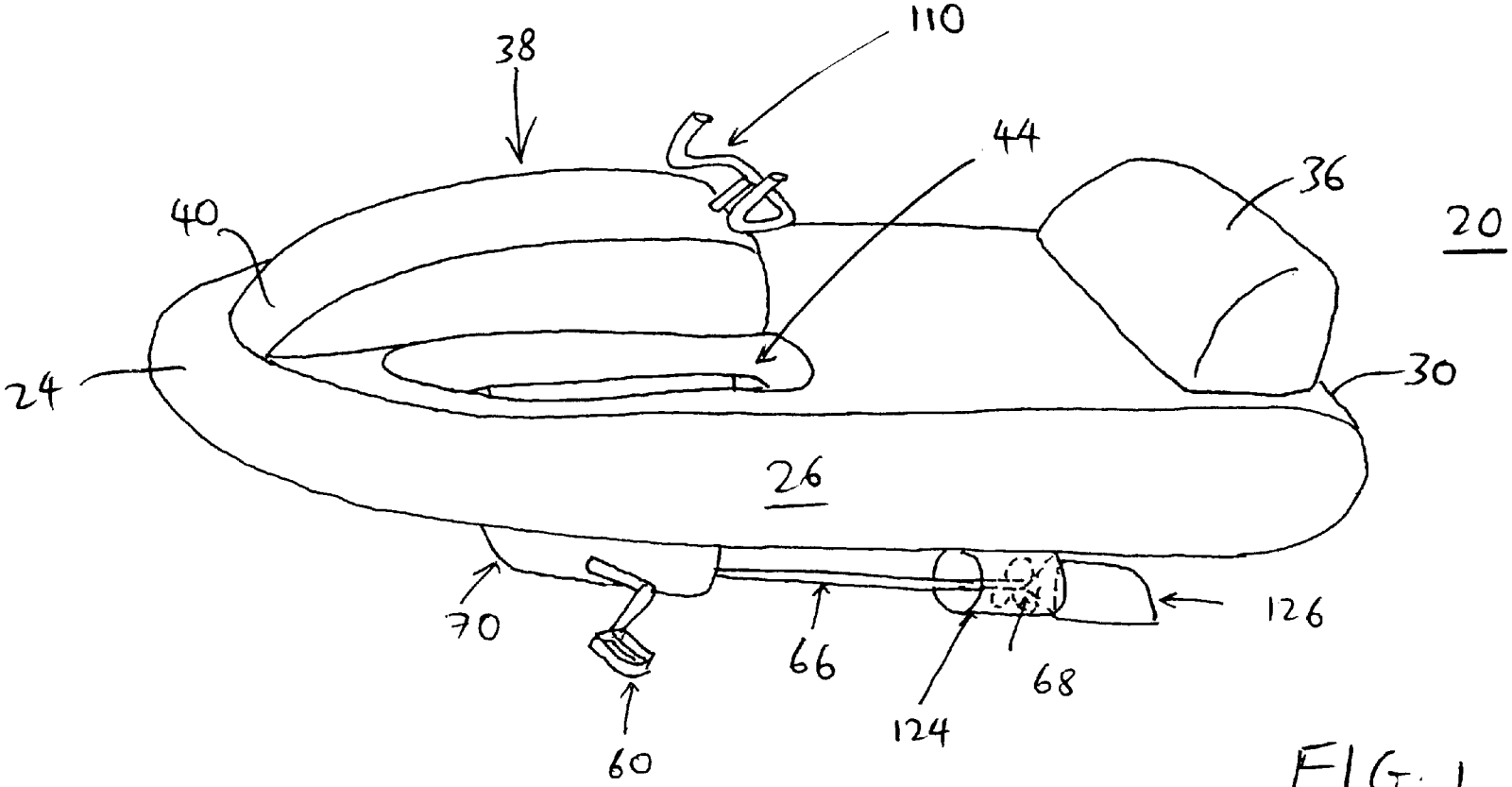
FIG. 1 is a front side perspective view of a water bicycle according to one embodiment of the present invention.
Figure 2:
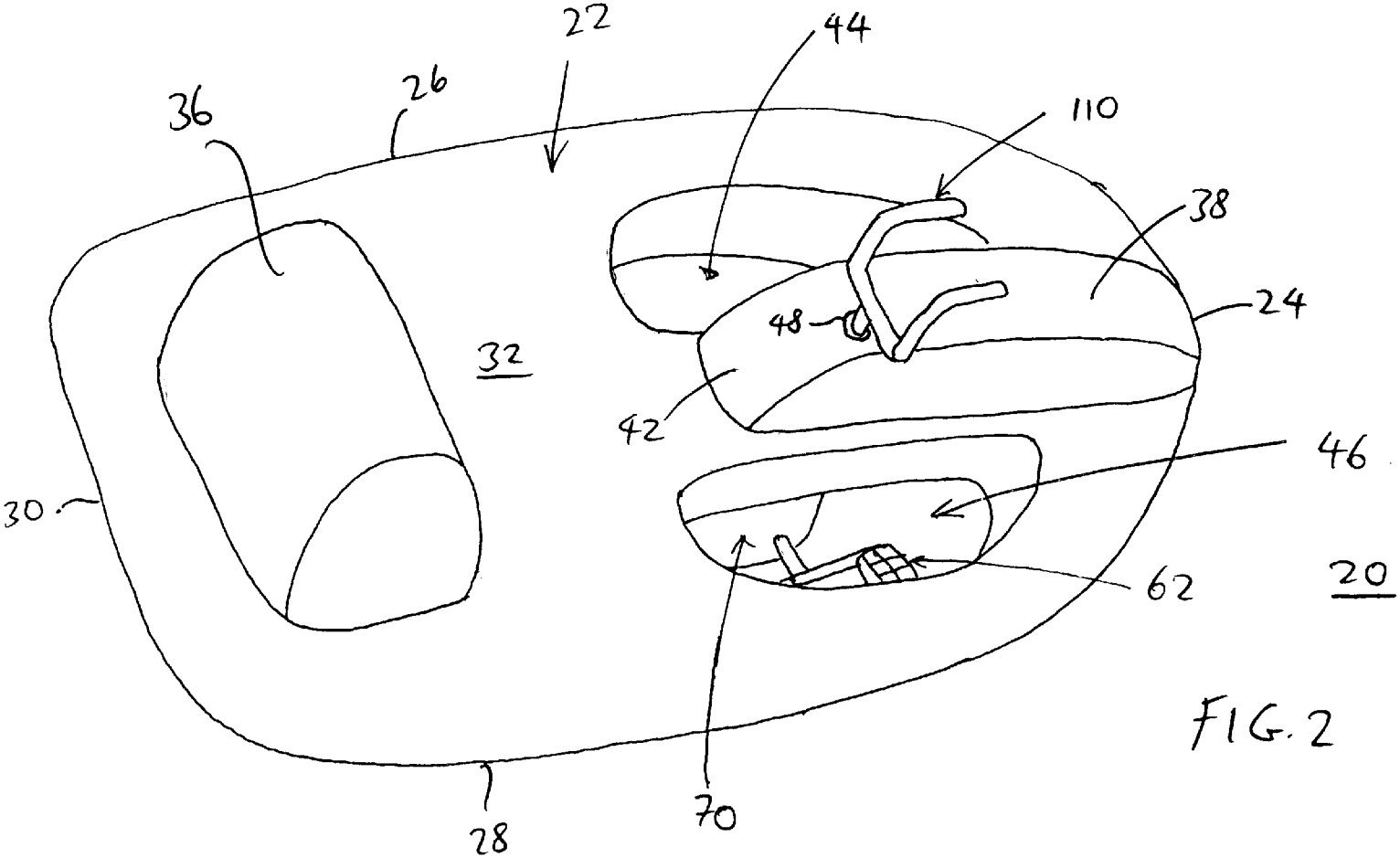
FIG. 2 is a rear side perspective view of the water bicycle of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

A water bicycle 20 according to the present invention is illustrated in connection with FIGS. 1–6. The water bicycle 20 has a body 22 that supports a steering system and a drive system that are described in greater detail below. The body 22 has a thickness (see T in FIG. 3), and has a curved front edge 24, two parallel side edges 26 and 28 that extend from the front edge 24, and a rear edge 30 that connects the side edges 26, 28. The body 22 also has a top surface 32 and a bottom surface 34. A back-rest 36 extends from the top surface 32 adjacent the rear edge 30. The back-rest 36 can be curved throughout or assume any configuration designed to provide user comfort while maximizing safety (i.e., by preventing the boat from tipping when the user leans against the back-rest 36). An elongated block 38 extends from about the center of the top surface 32 (i.e., between the parallel side edges 26, 28), and is positioned with one end 40 adjacent the front edge 24 and a second opposing end 42 that is about halfway between the front edge 24 and the rear edge 30.

Two elongated openings 44 and 46 extend through the thickness of the body 22 from the top surface 32 to the bottom surface 34, with one opening 44 provided on one side of the block 38 between the block 38 and the side edge 26, and the other opening 46 provided on the other side of the block 38 between the block 38 and the side edge 28. Each opening 44, 46 is aligned with a separate pedal 60, 62 of the drive system, so that a user can extend one leg through each opening 44, 46 to step on one pedal 60, 62 of the drive system. In addition, a bore 48 extends from the top of the block 38 through the thickness of the body 22 to the bottom surface 34 for receiving a shaft 112 of the steering system, as described below.

The body 22 can be made from any material that facilitates flotation. For example, the body 22 can be made from a soft flexible material (such as PVC, among others), and provided with a hollow interior and an air inlet (not shown) for allowing air to be introduced into the hollow interior to inflate the body 22, such as like the body of a conventional inflatable pool. As another example, the body 22 can be made in one integral piece of foam or other similar material that has sufficient buoyancy to float. In both examples, the block 38 and the back-rest 36 can be made in one piece with the rest of the body 22.

Figure 3:
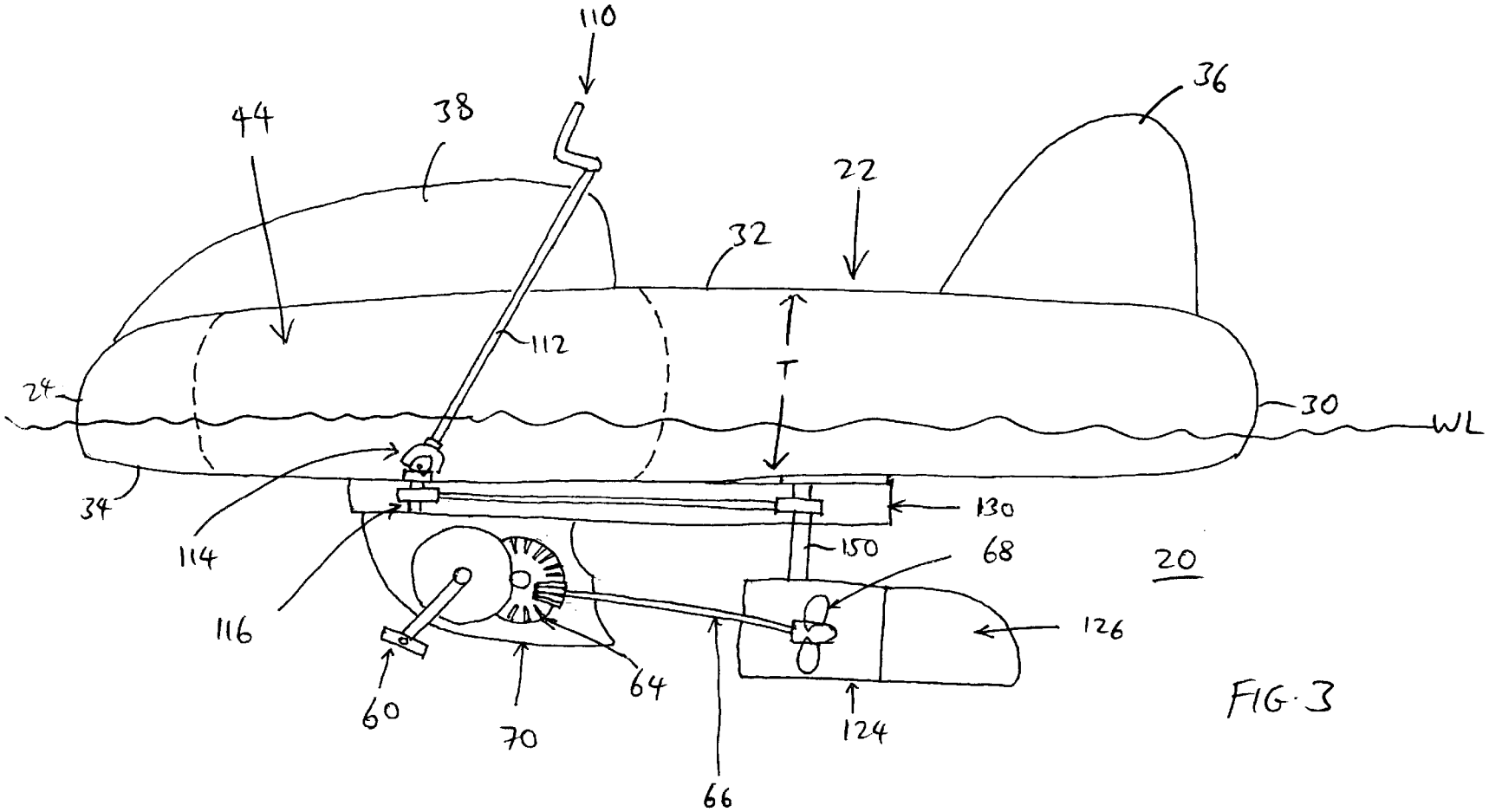
FIG. 3 is a cross-sectional side view of the water bicycle of FIG. 1.
Figure 5:
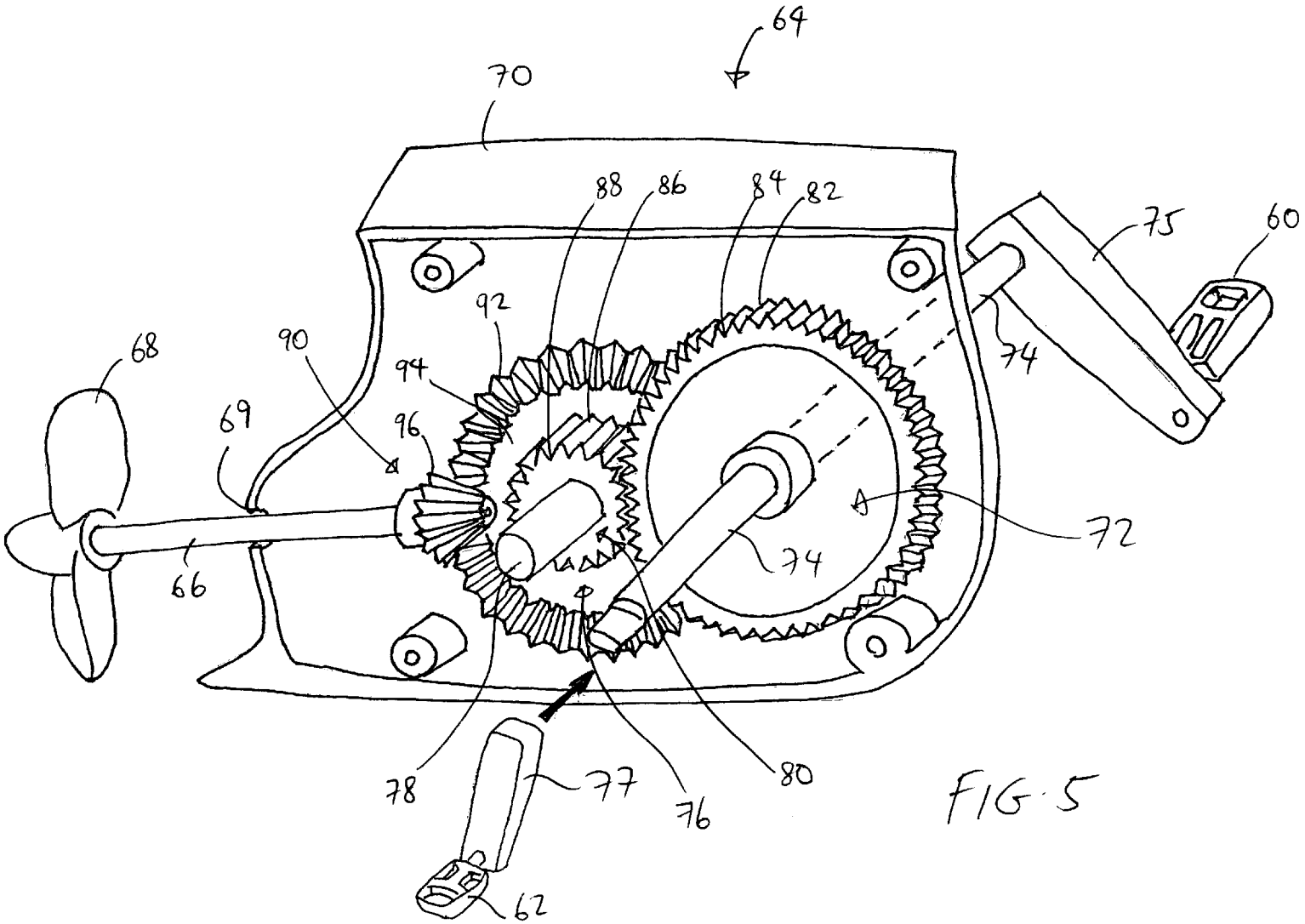
FIG. 5 is a sectional view of the drive system of the water bicycle of FIG. 1.
Figure 6:
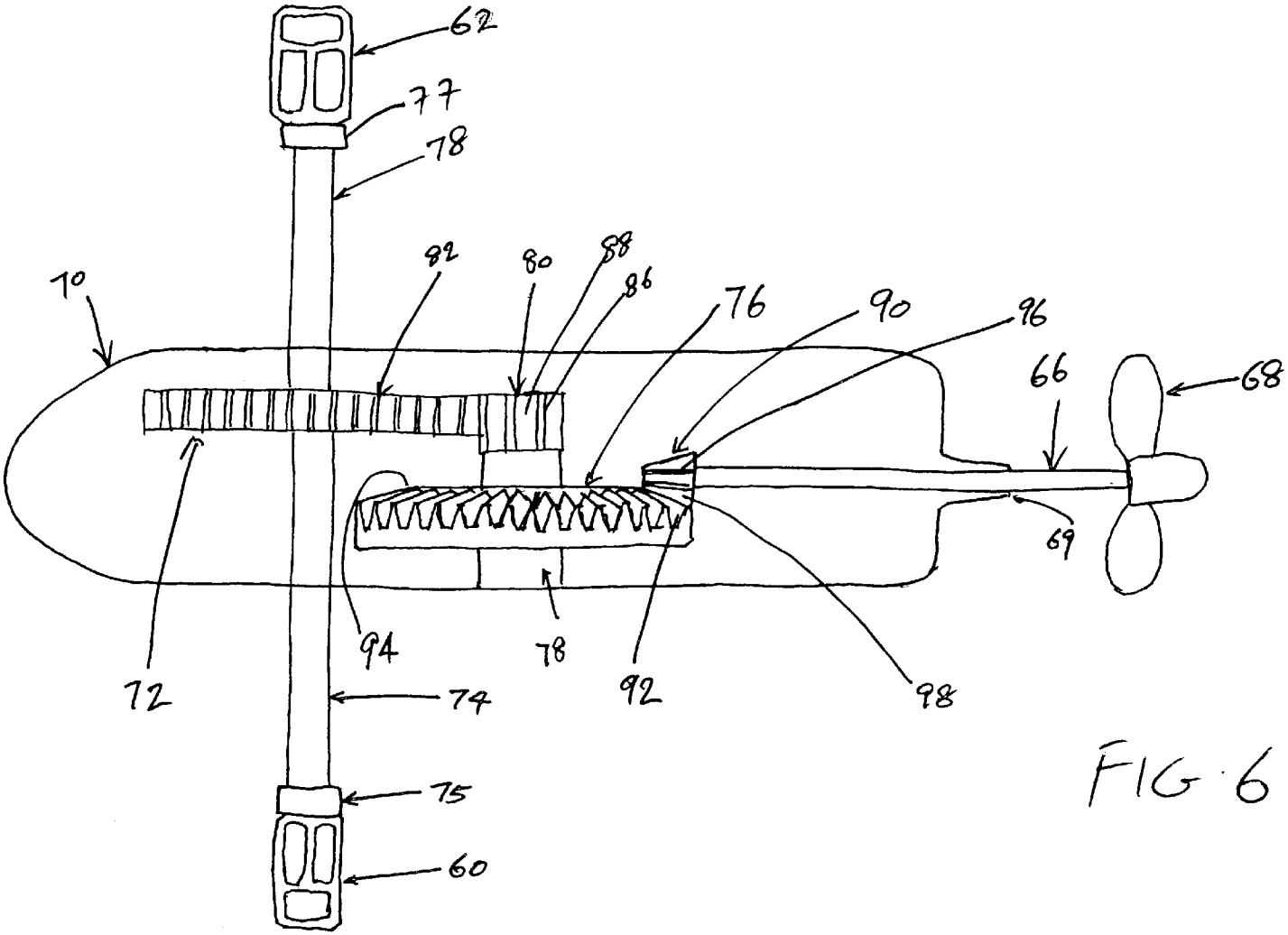
FIG. 6 is a top plan view of the drive system of FIG. 5.

The drive system is best illustrated in FIGS. 1, 3 and 5. The drive system includes two pedals 60 and 62 that operate to control the drive system, a gear system 64 that is best illustrated in FIGS. 5 and 6 and which operates as a drive mechanism, a propeller shaft 66, and a propeller 68. The gear system 64 is retained in a gear housing 70, which is illustrated in FIG. 5 with part of the housing 70 removed. The gear system 64 includes a first gear 72 having a first gear shaft 74 that extends outside the housing 70. The crank 75 of the first pedal 60 is supported on one end of the first gear shaft 74, and the crank 77 of the second pedal 62 is supported on the opposing end of the first gear shaft 74. The gear system 64 includes a second gear 76 having a second gear shaft 78 on which is supported a cam block 80. A third gear 90 is configured as a truncated cone and is positioned to engage the second gear 76. Teeth are provided on each of the gears 72, 76 and 90, and the cam block 80. Therefore, the teeth 82 on the peripheral edge 84 of the first gear 72 is adapted to be engaged by the teeth 86 on the peripheral surface 88 of the cam block 80, and the teeth 92 on the side 94 of the second gear 76 is adapted to be engaged by the teeth 96 on the conical peripheral surface 98 of the third gear 90. A first end of the propeller shaft 66 is connected to the third gear 90, and the propeller 68 is connected to the second opposing end of the propeller shaft 66. The propeller shaft 66 extends through an opening 69 in the housing 70.

In operation, the user steps on the pedals 60, 62 and rotates them as if he or she were riding a bicycle. Rotation of the pedals 60 and 62 causes the gear shaft 74 to rotate, thereby rotating the first gear 72. Rotation of the first gear 72 will rotate the cam block 80 because of the engagement between their respective teeth 82 and 86. Since the cam block 80 and the second gear 76 are carried on the same gear shaft 78, the rotation of the cam block 80 will rotate the second gear 76. As the second gear 76 rotates, its side teeth 92 engages the teeth 96 on the third gear 90 to rotate the third gear 90, thereby rotating the propeller shaft 66 and the propeller 68 to power the water bicycle 20.

Figure 4:
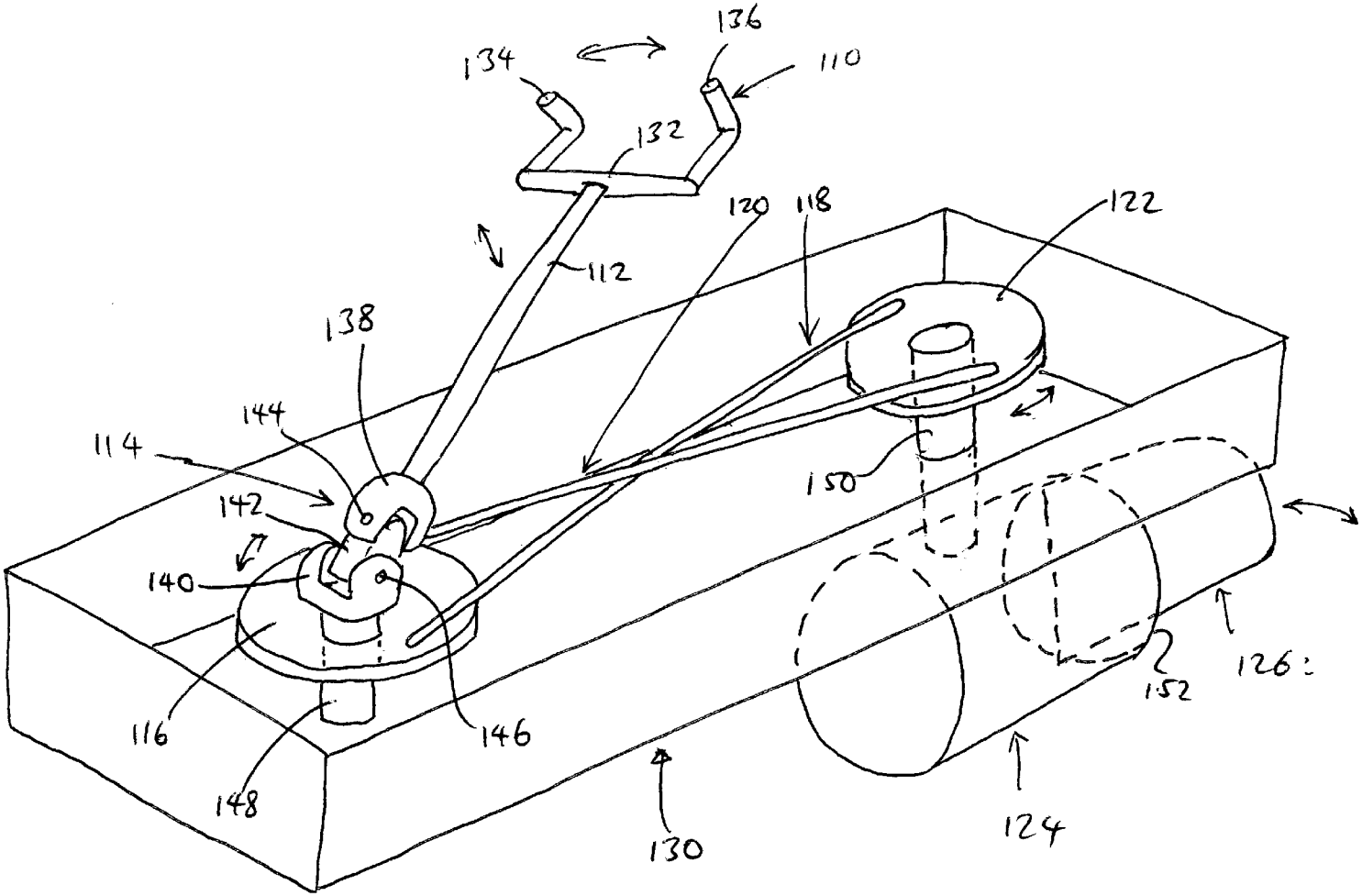
FIG. 4 is a perspective sectional view illustrating the steering system of the water bicycle of FIG. 1.

The steering system is best illustrated in FIGS. 1, 3 and 4. The steering system includes a steering handle 110 that is connected to a steering shaft 112, a universal joint 114 that rotatably couples the steering shaft 112 to a first flywheel 116, a pair of crossing rods 118 and 120 that couple the first flywheel 116 to a second flywheel 122, a generally cylindrical propeller housing 124 that is coupled to the second flywheel 122, and a rudder 126 that is connected to the propeller housing 124. The flywheels 116, 122, the rods 118, 120, the steering shaft 112, the propeller housing 124 and the shaft 150 essentially make up a link assembly between the handle 110 and the rudder 126. The steering system is housed in a steering housing 130 that is connected (e.g., by glue, rivets, screws, welding, or the like) to the bottom surface 34 of the body 22.

The steering handle 110 has a horizontal bar 132 with two separate vertical bars 134, 136 extending from the ends of the horizontal bar 132. One end of the steering shaft 112 is connected to a central portion of the horizontal bar 132, and the shaft 112 extends through the bore 48 and an opening in the steering housing 130 to a first U-shaped hub 138 of the universal joint 114. The universal joint 114 includes the first hub 138, a second U-shaped hub 140, and a support piece 142 that movably couples the first and second hubs 138, 140. A portion of the support piece 142 is movably received inside the first U-shaped hub 138 via a pin 144, and a separate portion of the support piece 142 is movably received inside the second U-shaped hub 140 via another pin 146. The pins 144 and 146 are oriented transverse or orthogonal to each other so as to allow the universal joint 114 to be turned and tilted in different directions.

The second hub 140 is secured to the first flywheel 116 via a shaft 148. The first flywheel 116 is adapted for rotation about the shaft 148, with the second hub 140 secured thereto to rotate together with the first flywheel 116. Similarly, the second flywheel 122 is supported by another shaft 150. The first ends of each of the crossing rods 118, 120 are connected to the first flywheel 116, and the opposing second ends of each of the crossing rods 118, 120 are connected to the second flywheel 122. The rods 118, 120 are positioned in a crossing orientation so that they cross each other at a central portion thereof, and are oriented in this manner so that rotation of the first flywheel 116 in one direction (e.g., clockwise) will cause the second flywheel 122 to rotate in the opposite direction (e.g., counterclockwise). The shaft 150 extends vertically downwardly through an opening in the housing 130 and is fixedly secured to the propeller housing 124. The propeller housing 124 houses the propeller 68. In addition, the rudder 126 is fixedly secured to the the rearward end 152 of the propeller housing 124.

Thus, the user controls the direction of the rudder 126 by turning the handle 110 sideways as he or she would turn a bicycle handle. The user uses one hand to grip one bar 134 and the other hand to grip the other bar 136. When the handle 110 is turned, the steering shaft 112 rotates and this rotation is translated to the first flywheel 116 via the universal joint 114. Rotation of the first flywheel 116 can be either clockwise or counterclockwise, and this rotation causes the second flywheel 122 to rotate (via the crossing rods 118, 120) in the opposite direction. When the second flywheel 122 rotates, the shaft 150 will rotate, causing the propeller housing 124 to turn or rotate in the same direction as the second flywheel 122. Since the rudder 126 is fixedly connected to the propeller housing 124, the rudder 126 will also be turned in the same direction as the propeller housing 124 and the second flywheel 122.

Referring to FIG. 3, the drive housing 70 is connected (e.g., by glue, rivets, screws, welding, or the like) to the bottom of the steering housing 130 adjacent the front of the steering housing 130.

The user can operate the water bicycle 20 in the following manner. First, the water bicycle 20 is placed on the water. The body 22 will float on the water, so that the housings 70 and 130, the propeller housing 124 and the rudder 126 are all submerged in the water. The water line WL in FIG. 3 illustrates the approximate water level when the water bicycle 20 is in use. The user then seats himself or herself on the region of the top surface 32 between the back-rest 36 and the block 38. The user can then insert his or her legs through the openings 44, 46, and the water bicycle 20 is ready for use. The user rides the pedals 60, 62 as would a conventional bicycle, and the drive system will cause the propeller 68 to rotate to drive the water bicycle 20 through the water in the manner described above. The user can also turn the handle 110 left and right to change the direction of the rudder 126 in the manner described above, thereby controlling the direction travelled by the water bicycle 20.

Thus, the water bicycle 20 according to the present invention is very easy and convenient to use, and has a simple construction that can be easily and conveniently transported from one location to another.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A water apparatus, comprising:

a body made from a material that allows the body to float on water; and a drive system connected to the body, the drive system including:

(i) a propeller that is positioned below the body;

(ii) a shaft having a first end coupled to the propeller and an opposing second end;

(iii) a drive mechanism coupled to the second end of the shaft; and (iv) a control coupled to the drive mechanism;

a steering system operatively connected to the body, the steering system having a rudder, a handle, and a link assembly operatively coupling the handle and the rudder, wherein the link assembly includes:

(a) a steering shaft having a first end and a second end connected to the handle;

(b) a first flywheel coupled to the first end of the steering shaft;

(c) a second flywheel coupled to the rudder;

(d) a pair of crossing rods each having opposing ends connected to the first and second flywheels; and (e) a universal joint coupling the first flywheel and the first end of the steering shaft.

2. The apparatus of claim 1, wherein the drive mechanism comprises a gear system housed in a housing.

3. The apparatus of claim 2, wherein the control is at least one pedal that is coupled to the gear system.

4. The apparatus of claim 1, wherein the body is made of foam.

5. The apparatus of claim 1, wherein the body is made from an inflatable material and has a hollow interior for holding air.

6. The apparatus of claim 2, wherein the body has a bottom surface, and wherein the housing for the drive system is connected to the bottom surface.

7. The apparatus of claim 1, wherein the body has a top surface and a bottom surface, and has a back rest provided on the top surface.

8. A water apparatus, comprising:

a body made from a material that allows the body to float on water; and a drive system connected to the body, the drive system including:

(i) a propeller that is positioned below the body;

(ii) a shaft having a first end coupled to the propeller and an opposing second end;

(iii) a drive mechanism coupled to the second end of the shaft; and (iv) a control coupled to the drive mechanism;

a steering system operatively connected to the body, the steering system having a rudder, a handle, and a link assembly operatively coupling the handle and the rudder, wherein the link assembly includes:

(a) a steering shaft having a first end and a second end connected to the handle;

(b) a first flywheel coupled to the first end of the steering shaft;

(c) a second flywheel coupled to the rudder;

(d) a pair of crossing rods each having opposing ends connected to the first and second flywheels; and (e) a propeller housing that is fixedly connected to the rudder, the propeller housing retaining the propeller and being coupled to the second flywheel.

9. The apparatus of claim 8, wherein the drive mechanism comprises a gear system housed in a housing.

10. The apparatus of claim 9, wherein the control is at least one pedal that is coupled to the gear system.

11. The apparatus of claim 8, wherein the body is made of foam.

12. The apparatus of claim 8, wherein the body is made from an inflatable material and has a hollow interior for holding air.

13. The apparatus of claim 9, wherein the body has a bottom surface, and wherein the housing for the drive system is connected to the bottom surface.

14. The apparatus of claim 8, wherein the body has a top surface and a bottom surface, and has a back rest provided on the top surface.

15. A water apparatus, comprising:

body made from a material that allows the body to float on water; and a drive system connected to the body, the drive system including:

(i) a propeller that is positioned below the body;

(ii) a shaft having a first end coupled to the propeller and an opposing second end;

(iii) a drive mechanism coupled to the second end of the shaft; and (iv) a control coupled to the drive mechanism;

a steering system operatively connected to the body, the steering system having a rudder, a handle, and a link assembly operatively coupling the handle and the rudder, wherein the link assembly includes:

(a) a steering shaft having a first end and a second end connected to the handle;

(b) a first flywheel coupled to the first end of the steering shaft;

(c) a second flywheel coupled to the rudder; and (d) a pair of crossing rods each having opposing ends connected to the first and second flywheels;

wherein the body has a top surface and a bottom surface, and a bore extending from the top surface to the bottom surface through which the steering shaft extends.

16. The apparatus of claim 15, wherein the drive mechanism comprises a gear system housed in a housing.

17. The apparatus of claim 16, wherein the control is at least one pedal that is coupled to the gear system.

18. The apparatus of claim 15, wherein the body is made of foam.

19. The apparatus of claim 15, wherein the body is made from an inflatable material and has a hollow interior for holding air.

20. The apparatus of claim 16, wherein the body has a bottom surface, and wherein the housing for the drive system is connected to the bottom surface.

21. The apparatus of claim 15, wherein the body has a top surface and a bottom surface, and has a back rest provided on the top surface.

22. A water apparatus, comprising:

a body made from a material that allows the body to float on water; and a drive system connected to the body, the drive system including:

a propeller that is positioned below the body;

a shaft having a first end coupled to the propeller and an opposing second end;

a drive mechanism coupled to the second end of the shaft; and a control coupled to the drive mechanism;

a steering system operatively connected to the body, the steering system having a rudder, a handle, and a link assembly operatively coupling the handle and the rudder; and wherein the body has a bottom surface, and further including a steering housing that houses the link assembly, with the steering housing connected to the bottom surface of the body.

23. The apparatus of claim 22, wherein the control is a pair of pedals, and wherein the body has a top surface and two openings extending from the top surface to the bottom surface and aligned with the two pedals.

24. The apparatus of claim 22, wherein the drive mechanism comprises a gear system housed in a housing.

25. The apparatus of claim 24, wherein the control is at least one pedal that is coupled to the gear system.

26. The apparatus of claim 22, wherein the body is made of foam.

27. The apparatus of claim 22, wherein the body is made from an inflatable material and has a hollow interior for holding air.

28. The apparatus of claim 24, wherein the body has a bottom surface, and wherein the housing for the drive system is connected to the bottom surface.

29. The apparatus of claim 22, wherein the body has a top surface and a bottom surface, and has a back rest provided on the top surface.

* * * * *